United States Patent [19]

Miske et al.

[11] Patent Number: 4,911,070

[45] Date of Patent: Mar. 27, 1990

[54] APPARATUS FOR SCREEN PRINTING WITH COOPERATING REGISTRATION STRUCTURE

[76] Inventors: Donald Miske, Apartment C-216, 2421 - 104 Street, Edmonton, Canada; Kenneth B. Miske, Box 1217, Beaumont, Alberta, Canada, T0C 0H0; Douglas J. Miske, 9339 - 70 Avenue, Edmonton, Alberta, Canada, T6E 0T8; Douglas J. K. L'Heureux, #1504, 11020 - 53 Avenue, Edmonton, Alberta, Canada, T6H OS4; Robert G. L'Heureux, 23054 C, Township Road 522, Sherwood Park, Alberta, Canada, T8B 1G9; Conrad K. L'Heureux, 6712 - 86 Street, Edmonton, Edmonton, Canada, T6E 2Y1

[21] Appl. No.: 239,276

[22] Filed: Sep. 1, 1988

[51] Int. Cl.[4] ..... B41F 15/18

[52] U.S. Cl. ..... 101/126; 101/481

[58] Field of Search ..... 101/126, 127.1, 128, 101/481

[56] References Cited

U.S. PATENT DOCUMENTS

| | | | |
|---|---|---|---|
| 2,369,290 | 2/1945 | Foard | 101/126 X |
| 4,084,504 | 4/1978 | Fuchs | 101/126 X |
| 4,649,815 | 3/1987 | Richardson | 101/126 |
| 4,722,272 | 2/1988 | Caruccio et al. | 101/126 |
| 4,750,421 | 6/1988 | Lucas | 101/128 |

FOREIGN PATENT DOCUMENTS

| | | | |
|---|---|---|---|
| 259776 | 3/1988 | European Pat. Off. | 101/126 |

*Primary Examiner*—Clifford D. Crowder

*Attorney, Agent, or Firm*—Ernest P. Johnson

[57] ABSTRACT

The apparatus comprises a cabinet for holding a stack of color-coded screen units for use in applying ink through a numeral stencil onto a garment. Stationary screen-supporting structure is provided for receiving each screen unit to be used and positioning and holding it in the same single operative location. More particularly, the screen-supporting structure and the screen unit have cooperating registration structure. A platen is provided for supporting the garment. The platen is linearly and laterally manually movable between central and left and right offset printing positions. Thus the garment may be positioned so that ink may be applied through the stencil onto the appropriate location on the garment. Registration structure is provided to control the positioning of the platen, to enable the user to accurately position the platen at one of the three printing positions for a numeral of a particular size. Color-coded visually-accessible structure is provided for guiding the user in moving the platen to the desired location.

4 Claims, 4 Drawing Sheets

APPARATUS FOR SCREEN PRINTING WITH COOPERATING REGISTRATION STRUCTURE

FIELD OF THE INVENTION

The present invention relates to an apparatus for screen printing characters onto a garment in register with pre-determined locations.

BACKGROUND OF THE INVENTION

The present system has been developed in conjunction with printing numerals onto athletic jerseys or binnies. It will be described below in conjunction with that particular application; however, it is contemplated that the system will also be applicable to other garments which require precise positioning and application of characters thereto using silk screening procedures.

In printing numerals onto athletic garments, one is concerned with the following requirements:

- the system should be capable of applying a single numeral centrally of the garment, or two numerals in balanced offset positions, or three numerals in central and balanced offset positions;
- the system should be capable of printing numerals of different sizes and, in some cases, in a plurality of colors (which involves sequentially using two or more screens, each of which is used to lay down a band of ink which forms part of the single numeral);
- the system should be easily usable by unskilled personnel and thus should not require a high degree of dexterity and expertise in positioning the stencilled screen relative to the garment; and
- the system should be characterized by high productivity.

The simplest prior art system in commercial use involves manually positioning a paper stencil on the garment and then using a screen to uniformly apply the ink. The problems inherent in this system are:

- a separate paper rectangle is used for each numeral - each rectangle has to be carefully positioned with skill to achieve the desired accurate positioning;
- when the screen is brought down onto the paper, the paper tends to shift; skilled personnel are needed;
- the system is characterized by low productivity; and thus the system is expensive to use.

A second commercial prior art system involves use of polymeric numbers having a heat-release paper sheet on the front. The numbers are manually positioned and a hot platen is then applied for about 30 seconds. The number bonds to the fabric. The front sheet is then peeled away. Again, the need for accurate positioning entails use of skilled workers and consumption of time. In addition, in some cases the number peels away with the paper sheet or scorching of the fabric can occur.

A third commercial prior art system involves using a lengthy screen having the stencil numerals 0–9 formed therein in spaced-apart sequence. A platen, on which the jersey to be numbered is to be positioned, is provided beneath the screen. The platen is carried by a carriage which may be moved along horizontally extending rails. The jersey is thus brought on the platen to a location beneath the desired numerals. The screen is pivoted down to the operating position and the ink is applied. Again, accurate positioning of the jersey relative to the stencil is a problem. This is particularly a problem if a two-colour number is to be created.

A fourth commercial prior art system is disclosed in U.S. Pat. No. 4,649,815, issued to Richardson. The Richardson assembly incorporates a fixed platen on which the jersey to be numbered is mounted and centered. A carriage is mounted on horizontal guide rails positioned behind the platen. The guide rails and carriage are in turn mounted on an arm which may be pivoted in a vertical plane. A screen may be coupled to the carriage by a bayonet connector. Thus the arm may be pivoted down to bring the screen to the operating position relative to the platen and jersey. A registration plate, having three holes, is attached to the stationary platen assembly. The carriage carries a downwardly projecting pin on its underside. When the carriage is shifted along the rails to an appropriate position and the screen arm is pivoted down, the pin will enter one of the registration plate holes. These holes are positioned so as to locate the screen in one of the three centered or offset printing positions required for numbering a jersey up to the numeral 99. Dots are provided on the front of the registration plate to indicate the location of the holes, so that the operator can visually determine when the pin is properly positioned relative to a hole.

The Richardson disclosure thus teaches the use of a horizontally shiftable screen associated with a pin-and-hole registration means and visual indicia for accurately positioning the screen in one of the three required positions relative to a jersey centered on a stationary platen. This enables a non-skilled person to accurately and automatically position one or two screens relative to a jersey to apply properly positioned numerals thereto.

SUMMARY OF THE INVENTION

The present invention incorporates the concept of automatic positioning disclosed in the Richardson patent and embodies it in a novel, simple, and more efficient assembly.

In a preferred form, the assembly comprises:

- A storage cabinet which forms a stack of shelves for holding a multiplicity of screen units, each such screen unit comprising a peripheral frame and a numeral stencil screen stretching across the frame opening;
- Screen support means extending forwardly and horizontally from a basic frame beneath the storage cabinet, said means typically consisting of a pair of parallel, horizontal, spaced-apart arms adapted to support two opposed sides of a screen frame;
- Means, such as a combination of pins and holes, carried in part by each of the screen unit frame and the support arms, for precisely positioning and fixing the former on the latter in the desired operating location;
- A manually operated, linearly and laterally movable horizontal platen, for supporting the garment, said platen being positioned between the screen support arms, so that the screen will overlie the garment, said platen being mounted on the outer end of a beam, the beam being rotatably supported between its ends by a transverse horizontal pivot rod, along which the beam may slide laterally. The beam has registration means, such as an upstanding locating pin, at its inner end, for engaging one of a multiplicity of registration means, such as holes, formed in or associated with a transversely extending horizontal registration rod which extends parallel to the pivot rod and is spaced rearwardly thereof. Thus the beam may be pivoted downwardly to release the locating pin, moved laterally to a new hole location, and pivoted upwardly to lock the locating pin in the second hole and thereby position the platen at a new printing position;

Said holes in the registration rod being accurately positioned and adapted to locate the platen in the centered and offset positions for a number of different numeral sizes (stated otherwise, there is a single centre hole which is common to all of the numeral sizes and a pair of offset holes, for each numeral size, which are specific to that numeral size);

Said screen frames preferably being colour-coded; and

Means, visible to the operator, for indicating the position of the locating pin relative to a registration hole of particular numeral size and orientation. Preferably a colour-coded line, corresponding to the coloring of the frames, indicates to the operator for a particular numeral size where the locating pin is relative to the centre and left and right hand offset holes for that numeral size.

In using the assembly, the operator:

mounts the jersey centrally on the platen;

selects the screen unit to be used by colour-coding (for size) and numeral;

adjusts the platen laterally to insert the locating pin in an appropriate hole, by using the colour-coded line which corresponds with the frame colour, thereby bringing the garment to the appropriate location;

fixes the screen unit on the stationary screen support means; and applies the ink through the screen stencil to form the numeral on the garment.

In summary, the invention provides a simplified and more efficient system by incorporating the following features:

The screen units, which are the variable components, are coupled with and positioned by registration means on a single unvarying fixed support means;

Registration means are coupled with the movable platen and garment, which latter components remain together during the course of applying numbers to one garment; and Means, such as colour-coding, are used to correlate the screen unit (numeral size and location) with the position of the locating pin.

In comparison to the Richardson system, the present system has eliminated the need for bayonet couplings and the changing of registration plates. The present system is characterized by having all of the registration holes needed for various numeral sizes on a single rod that remains in the assembly and has coupled this with visually accessible pin location guidance means, so that the locating pin can be accurately emplaced in the appropriate hole amongst the closely spaced array of holes. The present system is cosiderably quicker in use than the prior art systems known to applicant.

Broadly stated, the invention is an assembly for use by an operator for selectively positioning a garment in printing relationship with a screen unit carrying registration means, for the purpose of screen printing a character in any of three linearly aligned printing positions, one of said positions being a center position and the other positions being laterally offset on each side of the center position, comprising: a sceen unit comprising a frame having means for registering with a support means; a support frame means; stationary screen support means, carried by the support frame means, for supporting the screen unit; first means, associated with said screen support means, for registering with the screen unit registration means to position said screen unit in a pre-determined location when said screen unit is mounted on said support means; a linearly, laterally, manually movable platen assembly for supporting the garment to be printed upon; second means, carried by the support frame means, for supporting the platen assembly and enabling and guiding the linear and lateral movement of said platen assembly between each of the printing positions; third means, carried by the support frame means, for registering with and releasably locking the platen assembly at one of each of the printing positions; fourth means, carried by the platen assembly, for registering and locking with the third means; said platen assembly being operative, when actuated by the operator, to cause the fourth means to engage the third means at a selected printing position and to bring the garment into printing relationship with the screen unit on the support means, said platen assembly further being operative, when actuated by the operator, to disengage the fourth means from the third means.

DESCRIPTION OF THE PREFERRED EMBODIMENT

Figure 1:
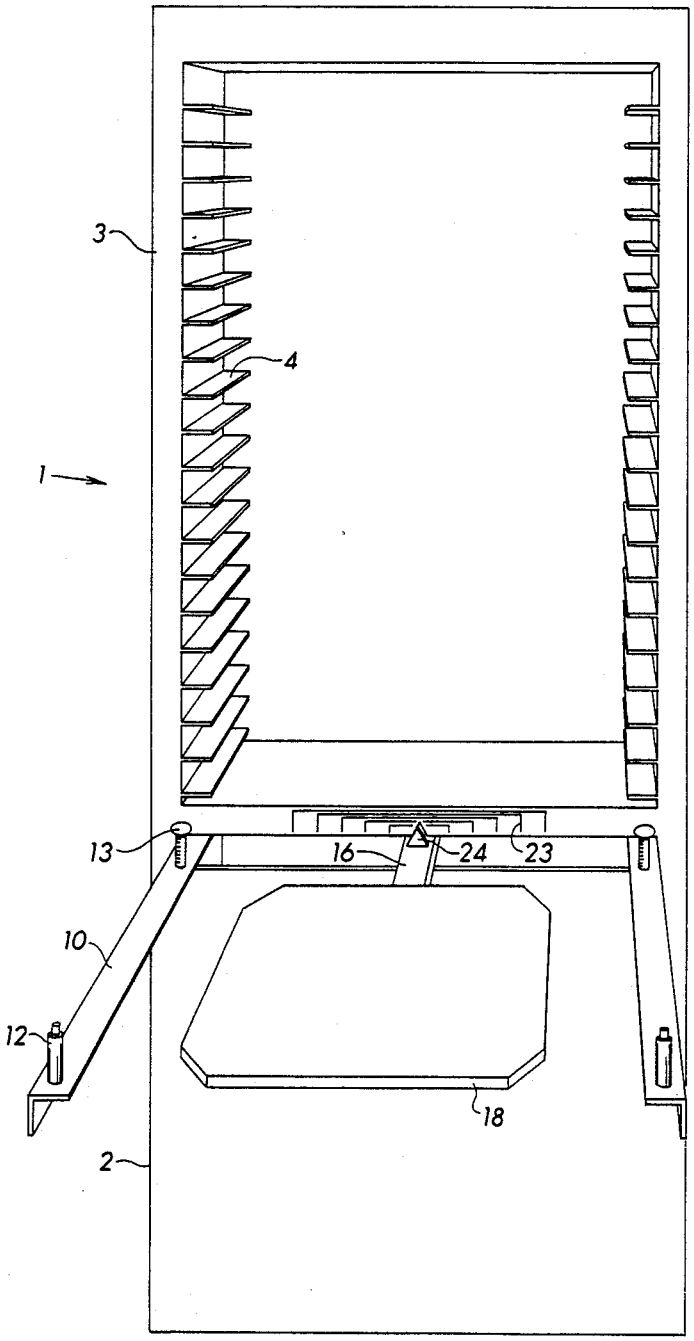
FIG. 1 is a perspective front view of the assembly.
Figure 2:
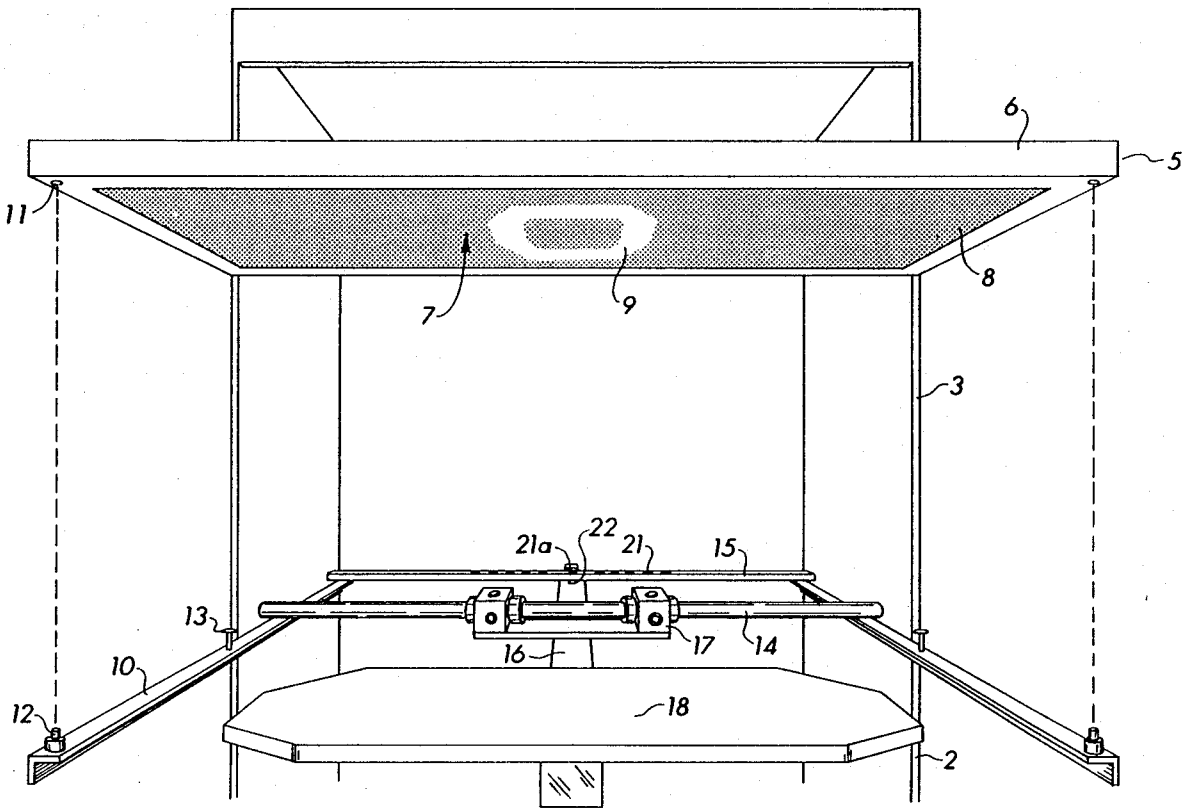
FIG. 2 is a perspective front view, with the housing partly removed, showing the platen assembly, pivot rod, and registration rod, and with a screen unit being lowered onto the support arms.
Figure 5:
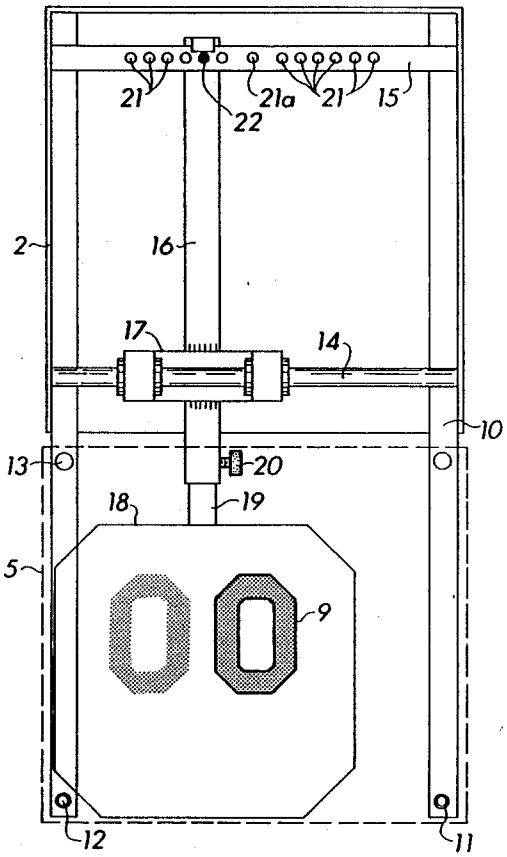
FIGS. 3–5 are top plan views showing a platen beneath a screen unit (shown in shadow lines) in the central, left, and right hand printing positions.
Figure 4:
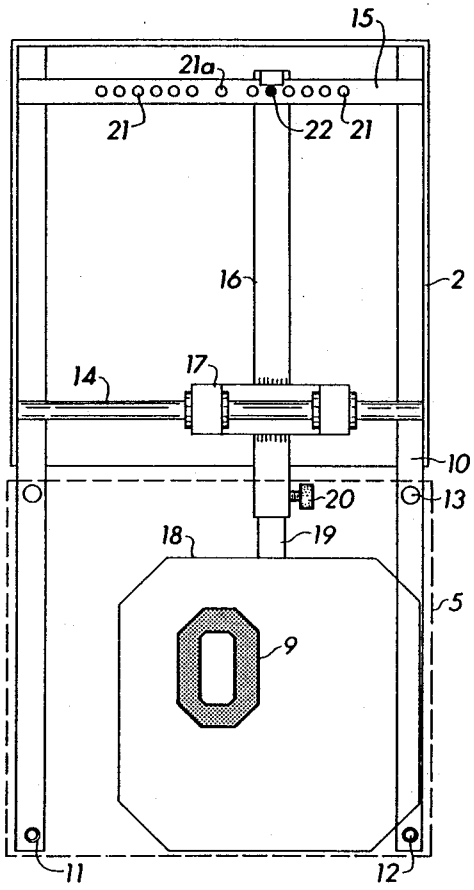
Figure 3:
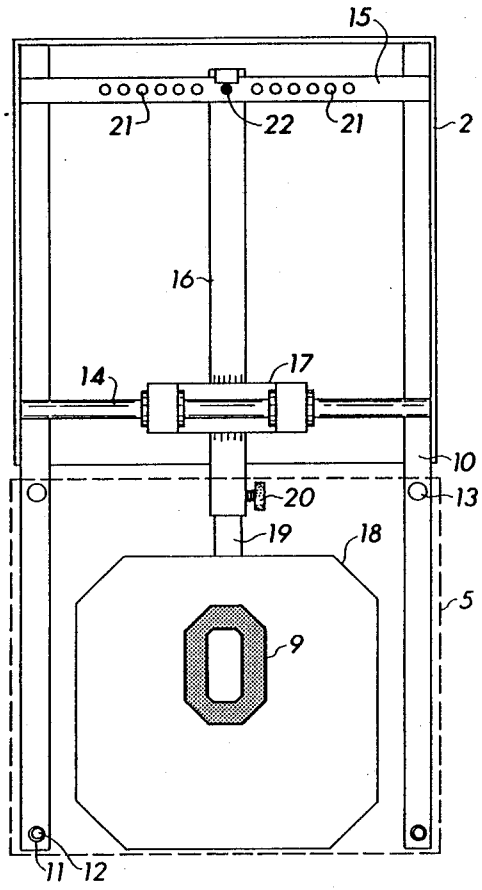
Figure 6:
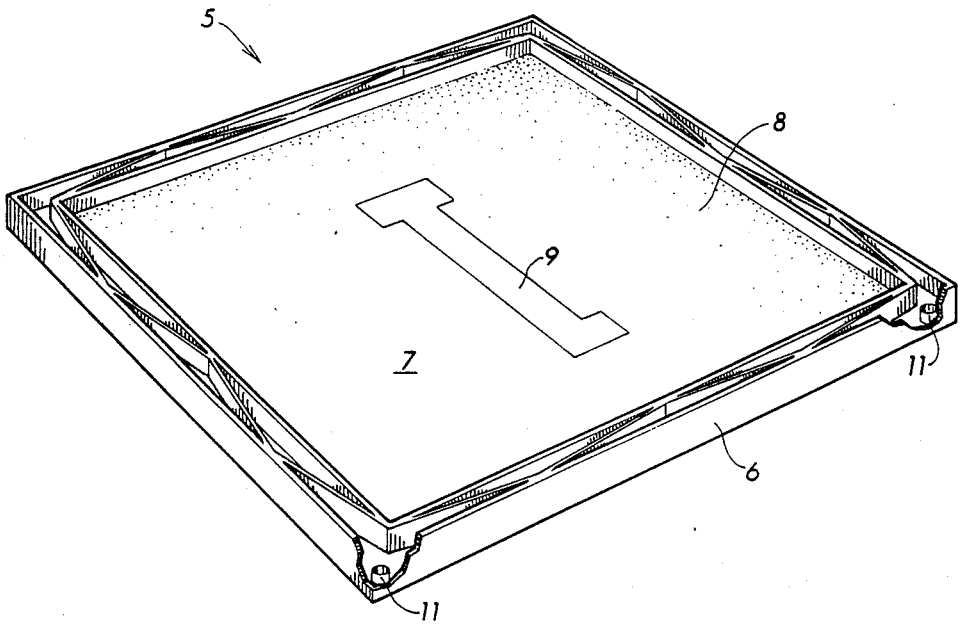
FIG. 6 is a perspective view of a screen unit.

The screen printing assembly 1 is a free-standing box-like unit having a support fram means or base section 2 supporting a screen storage cabinet 3. The cabinet 3 is open-fronted and forms a stack of shelves 4, for supporting the stencil screen units 5.

Each screen unit 5 consists of a rectangular peripheral frame 6 forming a central opening 7. A numeral stencil screen 8 is attached to the bottom of the frame 6 and extends across the opening 7. The numeral-forming portion or stencil 9 of the screen 8 is centrally positioned. The screen unit is conventional, except for the colour-coding of the frame 6 and the incorporation therein of registration holes 11, for a purpose described below.

The numerals to be applied by a printing unit will vary in size, typically from 3" to 12". To identify the different sizes, we colour the frames of one stencil size a common colour.

A pair of stationary horizontal, spaced-apart arms 10 extend forwardly in a common plane from the base section 2. The arms 10 are adapted to support the opposed sides of a screen frame 6 in the operative or printing position.

Means are provided for positioning each screen unit 5 in the same location when it is mounted on the arms 10. More particularly, each frame 6 forms registration holes 11 at its forward corners and the arms 10 carry stationary upstanding registration pins 12 at their forward ends. The holes 11 are positioned at the same locations for each of the frames 6. Thus the pins 12 function to locate the stencil 9 of each screen unit 5 at precisely the same location, when they engage the holes 11. A pair of pins 13 extend upwardly from the rear ends of the arms 10, for maintaining the screen unit 5 mounted thereon in a horizontal plane.

A horizontal pivot rod 14 is supported by the base section 2 at a point rearwardly of and just below the location to be occupied by a screen unit 5 when the latter is mounted on the support arms 10. A horizontal registration rod 15 is supported by the base section 2 in generally co-planar, parallel, rearwardly-spaced relationship relative to the pivot rod 14.

A tubular beam 16 extends transversely of the pivot and registration rods 14, 15. The beam 16 is mounted between its ends to the pivot rod 14 by bearing assembly 17, so that it may pivot in a vertical plane about the pivot rod 14 and may slide laterally therealong.

A platen 18, having a stem 19 extending therefrom, is provided. The stem 19 of the platen is received in the forward end of the beam 16 and is locked therein by a lock screw 20. The platen 18 is therefore carried by the beam 16 and together they make up a platen assembly.

The beam 16, pivot and registration rods 14, 15 and platen 18 are positioned so that the platen 18 is between the support arms 10 and in a plane just below a screen unit 5 when the latter is mounted on the arms. The platen assembly supports the garment in close proximity beneath the screen unit 5 in printing relationship therewith. Thus a garment (not shown) supported by the platen may be inked through the numeral stencil 9 of the screen unit 5.

The registration rod 15 has a plurality of spaced-apart vertical holes 21 formed therein. The holes 21 are provided in sets of three and the holes of each set are positioned so as to locate the platen 18 at the centre and left and right off-set positions for a particular numeral size. The centre hole 21*a* is of course common to each set. The beam 16 has an upstanding pin 22 located along its axis and at its rear end, which pin may be inserted into a particular registration hole by pivoting the beam upwardly. In this manner, the jersey carried by the platen 18 can be accurately located in a printing position in operating relationship relative to the stationary screen unit 5 carried by the support arms 10.

The pin 22 and registration holes 21 thus cooperate to provide means for positioning and releasably locking the platen assembly at each of the printing positions.

Lines 23, each of a different colour, are provided on the front of the base section 2. The lines 23 are positioned above the platen 18 and are thus visually accessible. Each line 23 ends at the left and right hand offset holes of one set of holes. Each such line 23 is coloured to match the screen unit colour whose position holes it is indicating.

The beam 16 carries an indicator 24 which corresponds with the axis of the beam.

In the operation of the assembly, the user centres the garment on the platen 18. The beam 16 is then rotated down, to free the registration pin 22, shifted laterally along pivot rod 14 until the beam indicator 24 is shown by the colored indicator line 23 to be at the location where the registration pin 22 will register with the appropriate registration hole 21. The beam 16 is then rotated up to engage the hole 21 with the pin 22 to lock the platen 18 at the appropriate printing position. A screen unit 5, having a centrally located stencil 9, is then placed on the support arms 10 with the pins 12 and holes 11 in register. The screen unit 5 has been selected according to desired numeral size (established by colour of the frame 6) and numeral. The ink is then applied in conventional fashion through the screen stencil.

The scope of the invention is defined in the claims now following.

The embodiments of the invention in which an exclusive property or privilege is claimed are defined as follows:

1. In combination:

means supporting a stack of screen units, each screen unit comprising a colour coded peripheral frame and a screen for printing a numeral;

a pair of parallel arms, extending in a common horizontal plane, for supporting opposed side portions of the screen unit frame in an operative position;

means, carried in part by each of a screen unit frame and the arms, for cooperating to position each screen unit in the same location when said screen unit is mounted on the arms;

a pivot rod extending horizontally in spaced relationship behind the location occupied by the screen unit in the operative position;

a registration rod extending horizontally in spaced relationship behind the pivot rod;

a beam, carrying a platen at its forward end for supporting a garment in operating relationship with the screen unit which is in the operative position on the support arms, said beam being rotatably mounted between its ends on the pivot rod and being laterally movable therealong, whereby the beam's rear end may be rotated up into contact or down out of contact with the registration rod and may be shifted laterally;

means, carried in part by the rear end of the beam and in part by the registration rod, for cooperating, when the beam is rotated up into contact with the registration rod, to releasably lock the beam and attached platen at any of a plurality of printing positions;

visually accessible means for indicating the position of the platen relative to each of the available printing positions, whereby the operator may be guided in moving the platen to the appropriate printing position; and frame means for supporting the arms, pivot rod, and registration rod.

2. An assembly for use by an operator selectively positioning a garment in printing relationship with a screen unit carrying registration means, for the purpose of screen printing a character in any of three linearly aligned printing positions, one of said positions being a center position and the other positions being laterally offset on each side of the center position, comprising:

a screen unit comprising a frame having means for registering with a support means;

a support frame means;

stationary screen support means, carried by the support frame means, for supporting the screen unit;

first means, associated with said screen support means, for registering with the screen unit registration means to position said screen unit in a predetermined location when said screen unit is mounted on said support means;

a linearly, laterally, manually movable platen assembly for supporting the garment to be printed upon;

second means, carried by the support frame means, for supporting the platen assembly and enabling and guiding the linear and lateral movement of said platen assembly between each of the printing positions;

third means, carried by the support frame means, for registering with and releasably locking the platen assembly at one of each of the printing positions;

fourth means, carried by the platen assembly, for registering and locking with the third means;

said platen assembly being operative, when actuated by the operator, to cause the fourth means to engage the third means at a selected printing position and to bring the garment into printing relationship with the screen unit on the support means, said platen assembly further being operative, when actuated by the operator, to disengage the fourth means from the third means.

3. The assembly as set forth in claim 2 comprising:

visually accessible means for indicating the position of the platen assembly relative to each of the available printing positions, whereby the operator may be directed in moving the platen assembly to the appropriate printing position.

4. The assembly as set forth in claim 3 wherein:

the platen assembly is operative to be pivoted vertically in one direction on the second means, when so actuated by the operator, to cause the fourth means to engage the third means at a selected printing position and to bring the garment into printing relationship with the screen unit on the support means, said platen assembly further being operative to be pivoted in an opposite vertical direction to disengage the fourth means from the third means.

* * * * *